United States Patent [19]

Bolongeat-Mobleu et al.

[11] Patent Number: 4,950,855

[45] Date of Patent: Aug. 21, 1990

[54] SELF-EXPANSION ELECTRICAL CIRCUIT BREAKER WITH VARIABLE EXTINGUISHING CHAMBER VOLUME

[75] Inventors: Roger Bolongeat-Mobleu, Echirolles; Regis Rival, Corenc Montfleury; Gérard Menou, Seyssinet-Pariset, all of France

[73] Assignee: Merlin Gerin, France

[21] Appl. No.: 265,393

[22] Filed: Oct. 31, 1988

[30] Foreign Application Priority Data

Nov. 4, 1987 [FR] France ..... 87 15467

[51] Int. Cl.[5] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 4,225,762 | 9/1980 | Zuckler | 200/148 A |
| 4,327,263 | 4/1982 | Sakurai et al. | 200/148 A |
| 4,359,616 | 11/1982 | Ueda et al. | 200/148 A |

FOREIGN PATENT DOCUMENTS

| | | |
|---|---|---|
| 0041081 | 6/1980 | European Pat. Off. . |
| 3024640 | 8/1981 | Fed. Rep. of Germany . |
| 1593994 | 7/1981 | United Kingdom . |

*Primary Examiner*—Robert S. Macon

*Attorney, Agent, or Firm*—Arnold, White & Durkee

[57] ABSTRACT

A self-expansion electrical circuit breaker includes an arc extinguishing chamber of variable volume by repulsion of a piston by the pressure of the gas in the extinguishing chamber. A semi-stationary contact is securedly united to the piston so as to increase the separation distance of the contacts at the same time as the volume of the extinguishing chamber increases.

2 Claims, 4 Drawing Sheets

SELF-EXPANSION ELECTRICAL CIRCUIT BREAKER WITH VARIABLE EXTINGUISHING CHAMBER VOLUME

BACKGROUND OF THE INVENTION

The invention relates to a self-expansion electrical circuit breaker comprising:

a sealed enclosure filled with a high dielectric strength gas, an arc extinguishing chamber located inside said enclosure and having a communication orifice with the enclosure and a wall arranged as a piston, movement of which causes a variation of the volume of the extinguishing chamber, said piston being urged towards the minimum extinguishing chamber volume position and moving due to the action of a pressure increase in the extinguishing chamber to increase the volume of the latter, a pair of contacts disposed in the arc extinguishing chamber, said communication orifice being closed off in the closed position of said pair of contacts and opening when separation of the contacts occurs to allow the compressed arc puffing gas drawn between the contacts of the extinguishing chamber to be outlet to the enclosure.

An electrical circuit breaker of the kind mentioned, notably medium or high voltage, requires a relatively low operating energy and enables the current to be broken by deriving the puffing energy from the arc, from the heat rise due to the arc. The puffing effect is no longer obtained by a mechanical piston effect, but by a heat rise due to the action of the arc which depends on a number of factors, notably the current intensity flowing in the circuit breaker, the volume of the extinguishing chamber and the speed of separation of the contacts. It is difficult to design a self-expansion circuit breaker capable of interrupting both low intensity currents, and very high intensity short-circuit currents. A chamber of small volume is well-suited to breaking weak currents but when a short-circuit current occurs, the volume of puffing gas is insufficient. If an extinguishing chamber with a large volume suited to breaking strong currents is used, the pressure increase is insufficient to blow out weak current arcs.

The object of the invention is to achieve a self-expansion circuit breaker having an arc extinguishing chamber with a volume adjusting to the intensity of the arc to be extinguished.

SUMMARY OF THE INVENTION

The self-expansion electrical circuit breaker according to the invention is characterized in that said contacts are arcing contacts on which the arc drawn when said contacts separate remains rooted until it is extinguished, and that one of the contacts is semi-stationary and securedly united to said piston, in such a way as to increase the separation distance of the contacts when the piston moves due to the action of the pressure in the extinguishing chamber due to the arc drawn between the contacts.

The gas pressure increase in the extinguishing chamber, and thereby the movement of the piston with an increased volume of the chamber, are directly connected to the current intensity feeding the arc and this arrangement adjusts the puffing intensity to that of the arc. By securedly uniting the semi-stationary contact and the piston, the separation distance between the two contacts increases at the same time as the volume of the extinguishing chamber to reach a maximum value at the moment the current passes zero or the arc is extinguished normally. Subsequently, the gas contained in the extinguishing chamber escapes and cools, resulting in a pressure decrease and movement of the piston and the semi-stationary contact in the reverse direction supplying the arcing zone with fresh puffing gas, providing a sufficient dielectric strength to prevent any restriking.

According to an embodiment of the invention, the elongated contacts are mounted with axial sliding, one of the contacts being movable and the other contact being mounted semi-stationary being rigidly secured to the piston bounding the arc extinguishing chamber. At least one and preferably both of the contacts are tubular to constitute escape orifices of the puffing gases via the contacts, these escape orifices being closed off in the closed and abutting position of the contacts. Semi-stationary mounting of one of the contacts ensures correct closing, regardless of the manufacturing tolerances, and the spring biasing the piston to the minimum extinguishing chamber volume position at the same time provides the contact closing pressure. In the closed position of the contacts, the piston is maintained by the abutting contacts in an intermediate position close to the minimum volume position. When a circuit breaker opening operation takes place brought about by sliding of the movable contact in the opening direction, the semi-stationary contact in the first phase accompanies the movable contact in its movement thus causing the gas in the extinguishing chamber to be compressed, due to the movement of the piston in the direction of the minimum volume position. This movement of the semi-stationary contact and the piston is brought about by the spring which maintains the semi-stationary contact in abutment with the movable contact. After this precompression phase and when movement of the movable contact is pursued, the semi-stationary contact comes up against the stop and is separated from the movable contact drawing an arc. This precompression of the puffing gases, well-known to those specialized in the art, favors high-speed arc extinction. Depending on the intensity of the arc, the piston remains in the minimum volume position or moves to increase the volume of the extinguishing chamber. As soon as the contacts separate, the gas compressed in the extinguishing chamber escapes via the tubular contacts to the circuit breaker enclosure.

The increase and reduction of the volume of the extinguishing chamber can result from the simple movement of the piston in one direction or the other, but according to a development of the invention, the extinguishing chamber can be subdivided into two compartments when the piston is in the minimum volume position, only one of the compartments constituting the extinguishing chamber so long as the piston remains in this position. When the pressure in the extinguishing chamber increases sufficiently to repel the piston, the two compartments come into communication to increase the volume of the extinguishing chamber. The wall separating the two compartments may be a cylindrical flange securedly united to the piston and coaxially surrounding the semi-stationary contact, this flange coming up against a stop to maintain the piston in the minimum volume position. In the abutment position, the cylindrical flange confines a small arc extinguishing chamber of sufficient volume to break weak currents.

The puffing effect due to the piston movement after the arc has been extinguished can be modulated by damping the piston movement, for example pneumatically by limiting the gas inlet in a space confined by the piston. A check valve of the limited orifice enables the piston to move freely in the contact separation direction. The damping space or volume is confined by the extinguishing chamber cylinder and by two end-plates, one formed by the face of the piston opposite the arc extinguishing chamber, and the other by a fixed end-plate closing off the cylinder.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
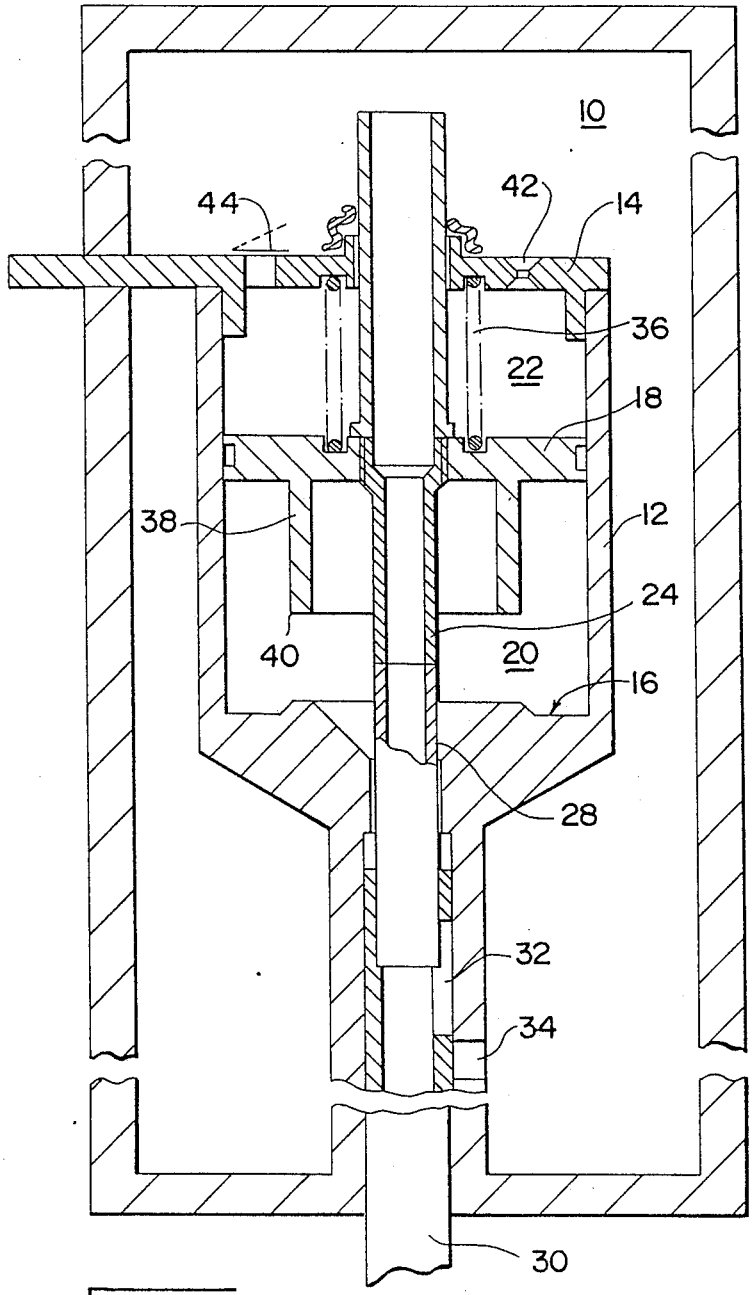
FIG. 1 is a schematic axial section view of a pole of a self-expansion circuit breaker according to the invention represented in the closed position.

In the figures, the pole comprises a sealed enclosure 10 filled with a high dielectric strength gas such as sulphur hexafluoride at low or atmospheric pressure. Inside the enclosure 10 there is fixed a cylinder 12 closed off by fixed end-plates 14 and 16. Inside the cylinder 12, a piston 18 is slidingly mounted bounding on the fixed end-plate 16 side an arc formation and extinguishing chamber 20 and on the opposite side a damping chamber 22. The piston 18 automatically controls a semi-stationary tubular contact 24 which passes through the piston 18 and the end-plate 14. The opposite end-plate 16 of the arc extinguishing chamber 20 has passing through it a movable tubular contact 28, extended inside the enclosure 10 by an operating rod 30. The cylinder 12 and operating rod 30 are made of insulating material, whereas the metal end-plate 14 is arranged as a current conducting terminal to the semi-stationary contact 24. The other current conducting terminal (not shown) cooperates by means of friction contacts with the movable contact 28. The inside of the semi-stationary contact 24 communicates freely with the enclosure 10 and the inside of the movable contact 28 communicates with this enclosure 10 via orifices 32, 34, respectively arranged in the movable contact 28 and in a guide sheath securedly united to the cylinder 12, these orifices 32, 34 coming to face one another to constitute a gas outlet orifice to the enclosure 10.

In the closed position of the circuit breaker represented in FIG. 1, the ends of the contacts 24, 28 are abutting and arranged inside the arc extinguishing chamber 20. A spring 36 inserted between the movable piston 18 and the end-plate 14 urges the contacts into abutment by providing the contact pressure. The face of the piston 18 bounding the arc extinguishing chamber 20 bears a cylindrical flange 38 whose free edge 40 is in proximity to the end of the semi-stationary contact 24. When downwards sliding of the piston 18 in FIG. 1 takes place, the edge 40 of the flange 38 comes up against the end-plate 16 bounding an extinguishing chamber of small volume. The damping volume 22 communicates with the enclosure 10 both via a limited orifice 42 and via a check valve 44 allowing the gas to escape freely from the damping volume 22 to the enclosure 10.

Figure 2:
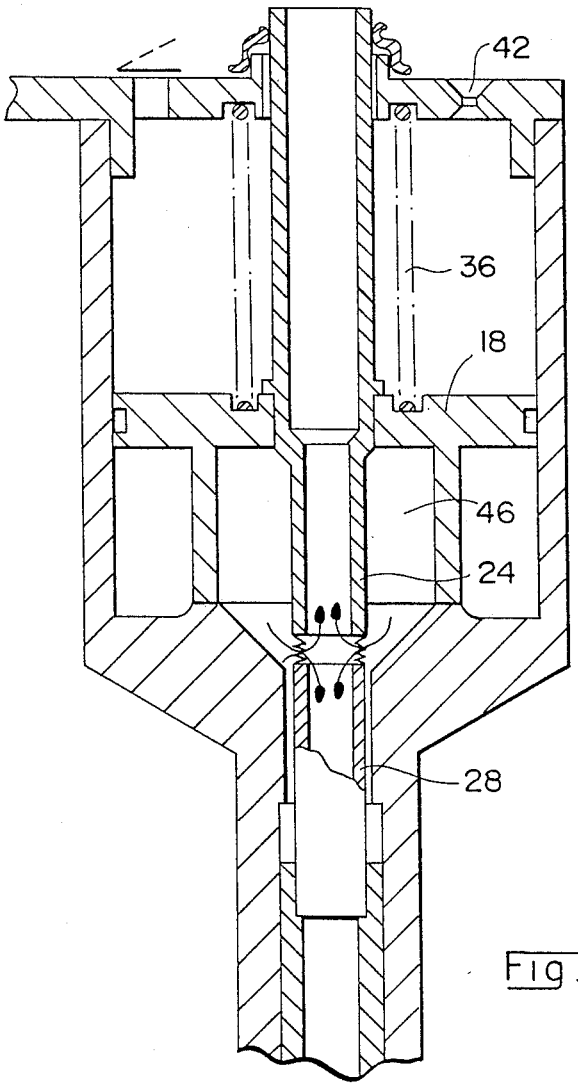
FIG. 2 is a similar view to that of FIG. 1, in which the enclosure is not represented, the pole being in the course of opening to break a weak current.

The circuit breaker according to the invention operates as follows:

In the closed position represented in FIG. 1, the contacts 24, 28 are in abutment and the piston 18 is maintained by the contacts 24, 28 in an intermediate position in which the edge 40 is separated from the end-plate 16. The pressure is uniform throughout the enclosure 10. A circuit breaker opening operation by downwards sliding of the operating rod 30 causes downwards sliding of the movable contact 28. In the first phase, the semi-stationary contact 24 in abutment with the movable contact 28 follows the latter in its movement due to the action of the spring 36 until the edge 40 comes up against the end-plate 16 which immobilizes the semi-stationary contact 24. Further movement of the movable contact 28 causes the contacts 24, 28 to separate and an arc to form between the separated contacts. In the first phase, the arc extinguishing chamber 20 is limited to a compartment 46 surrounded by the flange 38. When a low intensity current is broken, the pressure increase in the compartment 46 due to the action of the arc is insufficient to repel the piston 18 against the force of the spring 36. The gas compressed in the compartment 46 escapes via the tubular contacts 24, 28 to the enclosure 10 puffing the arc drawn between the separated contacts 24, 28. The small volume of the arc extinguishing chamber 20 formed by the compartment 46 provides a sufficient pressure increase and enables puffing to take place to extinguish the low intensity arc (FIG. 2).

Figure 3:
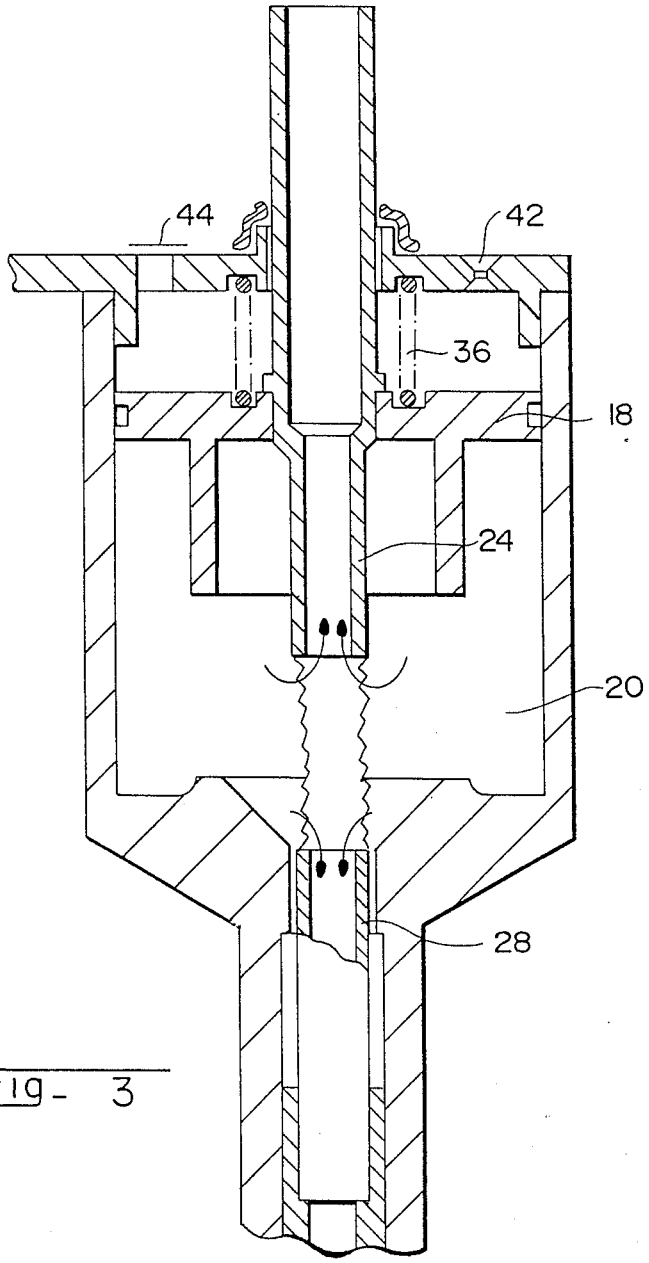
FIG. 3 is a similar view to that of FIG. 2, showing the pole in the arc extinguishing position when a strong current occurs.

When a high intensity current, notably a short-circuit current, is broken, the high intensity arc heats the gas in the compartment 46 sufficiently to move the piston 18 in the direction increasing the volume of the arc extinguishing chamber 20. As soon as the edge 40 is separated from the end-plate 16, the whole volume of the extinguishing chamber 20 is subjected to the action of the arc and the piston 18 is repelled to a maximum volume position of the extinguishing chamber 20 represented in FIG. 3. Opening of the valve 44 allows free movement of the piston 18 enabling the gas contained in the damping volume 22 to escape to the enclosure 10. The large volume of gas stored under pressure in the arc extinguishing chamber 20 due to the movement of the piston 18 enables puffing of the arc or more exactly of the separation zone of the contacts 24, 28, to be achieved, after the arc has been extinguished when zero current is passed.

Figure 4:
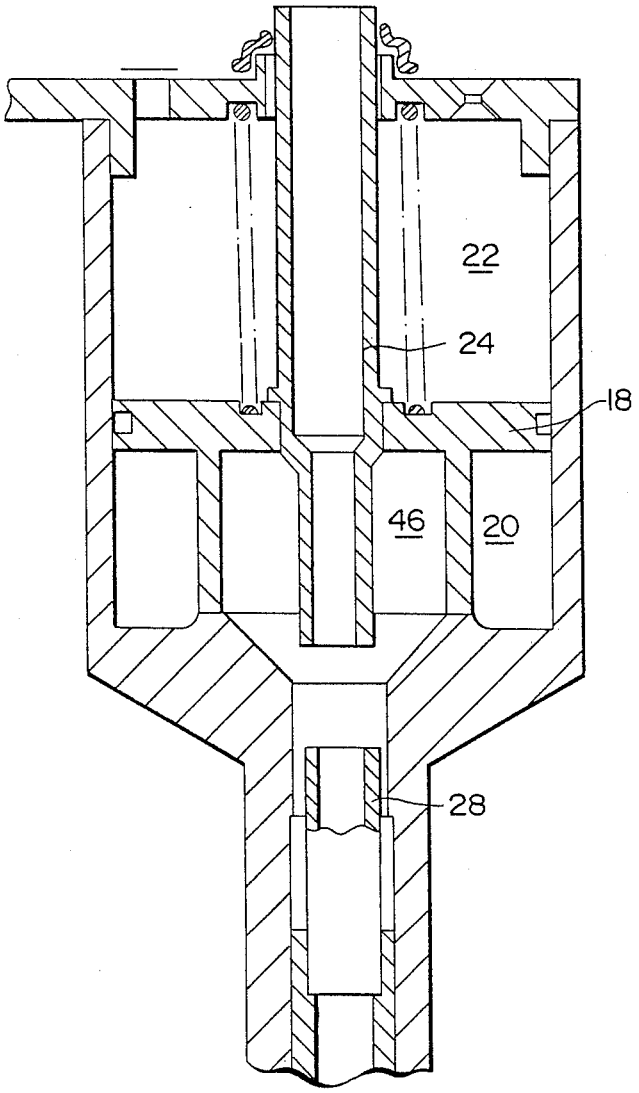
FIG. 4 is a similar view to FIGS. 1 to 3, showing the pole in the open position.

As soon as the arc has been extinguished, the pressure in the arc extinguishing chamber 20 decreases and the piston 18 is driven back by the spring 36 causing puffing of the gases via the contacts 24, 28, to bring fresh gases into the contact separation zone and prevent any arc restriking. The speed of movement of the piston 18 and thereby the puffing intensity depends on the differential force between the spring 36 and the pressure existing in the arc extinguishing chamber 20, and this speed of movement can be modulated by limiting the gas inlet to the damping volume 22 through the limited orifice 42. By choosing a sufficiently small cross-section of the limited orifice 42, puffing can be maintained during a sufficient time for the dielectric strength to be regenerated in the contact separation zone. The movement of the piston 18 during the time the arc persists drives the semi-stationary contact 24 to a position separated from the movable contact 28 which favors extinction of the arc when zero current is passed. This separation naturally decreases with the return of the piston 18 to the open position represented in FIG. 4, but this reduction occurs after the arc has been extinguished and the dielectric strength has been restored. The combined effect according to the invention of storing of the puffing gas and increased separation of the contacts favors extinction of high intensity arcs, whereas the small volume of the arc extinguishing chamber is favorable to breaking weak currents. The assembly is particularly simple and adustment to the current intensity to be broken is fully automatic. Using a self-puffing effect by expansion allows an extremely low operating effort, all the puffing and gas storage energy being derived from the arcing energy.

The invention is naturally in no way limited to the embodiment more particularly described herein.

We claim:

1. A self-expansion electrical circuit breaker comprising:

a sealed enclosure filled with a high dielectric strength gas;

an arc extinguishing chamber located inside said enclosure and having a communication orifice with the enclosure and a wall arranged as a piston, movement of which causes a variation of the volume of the extinguishing chamber, said piston being urged towards the minimum extinguishing chamber volume position and moving due to the action of a pressure increase in the extinguishing chamber to increase the volume of the latter;

a pair of contacts disposed in the arc extinguishing chamber, said communication orifice being closed off in the closed position of said pair of contacts and opening when separation of the contacts occurs to allow the compressed arc puffing gas drawn between the contacts of the extinguishing chamber to be outlet to the enclosure;

damping means for the piston movement in the direction of the minimum volume position to spread the gas supply by piston effect over a longer period;

wherein said contacts are arcing contacts on which the arc drawn when said contacts separate remains rooted until it is extinguished and one of the contacts is semi-stationary and securedly united to said piston, in such a way as to increase the separation distance of the contacts when the piston moves due to the action of the pressure in the extinguishing chamber due to the arc drawn between the contacts.

2. The circuit breaker according to claim 1, wherein said means for damping comprises a space bounded by said piston and having a limited cross-section gas outlet orifice and a check valve of said orifice in the direction of piston movement towards the maximum volume position.

* * * * *